US010621958B2

(12) United States Patent
Peace

(10) Patent No.: US 10,621,958 B2
(45) Date of Patent: Apr. 14, 2020

(54) STOP BAR FOR A STRINGED MUSICAL INSTRUMENT

(71) Applicant: Christopher Michael Peace, Hampshire (GB)

(72) Inventor: Christopher Michael Peace, Hampshire (GB)

( * ) Notice: Subject to any disclaimer, the term of this patent is extended or adjusted under 35 U.S.C. 154(b) by 0 days.

(21) Appl. No.: 15/927,701

(22) Filed: Mar. 21, 2018

(65) Prior Publication Data

US 2019/0295515 A1 Sep. 26, 2019

(51) Int. Cl.
*G10D 3/12* (2020.01)
*G10D 3/04* (2020.01)

(52) U.S. Cl.
CPC ..... *G10D 3/12* (2013.01); *G10D 3/04* (2013.01)

(58) Field of Classification Search
CPC ..... G10D 3/12; G10D 3/04
See application file for complete search history.

(56) References Cited

U.S. PATENT DOCUMENTS

2008/0034939 A1* 2/2008 Matsubara ..... G10D 3/04 84/298
2013/0055876 A1* 3/2013 Mason ..... G10D 3/04 84/298

* cited by examiner

*Primary Examiner* — Kimberly R Lockett
(74) *Attorney, Agent, or Firm* — William H. Bollman

(57) ABSTRACT

This invention relates generally to a stop bar for a stringed musical instrument. The field of the invention is stringed musical instruments. The purpose of the stop bar is to anchor a musical string to the sound board of the musical instrument in a manner that reduces breakage of musical strings of the instrument compared to conventional stop bars. The stop bar according to the invention arranged to attach to a sound board of a stringed musical instrument and to guide strings of the instrument, said strings are anchored to the stop bar at a first location and pass through guides formed in the stop bar so that a string defines a straight line from the first location to a saddle which separates the strings from the sound board.

17 Claims, 3 Drawing Sheets

STOP BAR FOR A STRINGED MUSICAL INSTRUMENT

FIELD OF THE INVENTION

This invention relates generally to a stop bar for a stringed musical instrument. The field of the invention is stringed musical instruments. The purpose of the stop bar is to anchor a musical string to the sound board of the musical instrument.

BACKGROUND

Stringed musical instruments such as a guitar, banjo, mandolin, and violin and so on, comprise a body from which a neck extends. The instrument has strings which are anchored to the body and stretched over the neck. The strings are tuned to a musical note by stretching them to a particular tension.

The body comprises a sound board. The strings are anchored to the sound board by a conventional stop bar which is joined to the sound board.

The strings are stretched from the stop bar over a saddle attached to the sound board. The saddle is located between the sound board and the strings. The saddle supports the strings so that the strings are held away from the sound board and the neck. There is a portion of the strings that are suspended over the sound board between the stop bar and the saddle. The saddle height over the sound board may be adjusted for fine tuning.

To enhance the musical sound of the musical instrument the strings are preferably anchored very close to the sound board by the stop bar.

The strings tend to break at the pinch or 'break' points where they are suspended by the saddle and grasped by the conventional stop bar. Replacing broken strings is an unwanted cost and annoying waste of time for musicians.

SUMMARY OF THE INVENTION

According to one aspect of the present invention there is a stop bar attachable to a stringed musical instrument sound board on which there is a saddle to support musical strings, comprising: anchor holders, and straight guides non parallel to a flat side of the stop bar attachable to the sound board at a first position distal from the saddle to guide the musical strings from the anchor holders to the saddle in straight lines in view of the sound board profile.

Advantageously the stop bar cooperates with an anchor for the string. For instance, the string may have a lump or ball attached at a free end. The ball diameter is greater than a diameter of the guide hole characterizing each of the straight guides. The ball and anchor holder cooperate to anchor the string in the stop bar. Where the ball is anchored against the stop bar is a first location of the string at an end of the straight line.

Preferably the guides pass through the stop bar. Preferably each guide is formed by a guide hole straight through the stop bar. Preferably each guide has a cross section minimum dimension in a range from 0.2 mm to 4 mm to provide clearance for each string. The strings preferably are clear of the guides. Advantageously there is no break point on the string from the anchor to the point where the string contacts the saddle.

The side of the stop bar facing the sound board is the sound board side. The flat side comprises preferably all the sound board side or preferably a portion of the sound board side.

The stop bar has a neck and saddle side. Preferably the neck side is substantially perpendicular to the flat side. The neck side faces towards the neck and the saddle of the instrument when the stop bar is attached to the sound board.

The stop bar has an anchor side. Preferably the anchor side is opposite the neck side and substantially parallel to the neck side. Preferably the anchor side is substantially perpendicular to the flat side.

Preferably the guides pass through opposite sides of the stop bar. Preferably the opposite sides are substantially perpendicular to the flat side. Preferably the straight guides pass through the stop bar from the anchor side to the neck side.

Preferably the guides have a first exit from the stop bar in register with the anchor holder and an opposite second exit further from the flat side than the first exit. Preferably the first exit is through the anchor side and the second exit is through the neck and saddle side.

Preferably the anchor holder comprises a recess opening into the guides. Preferably the recess opens into the first exit. Preferably the recess opening has a cross section in the anchor side exceeding the minimum cross section of the guides. Preferably the recess has a form to receive an anchor in form of a lump on an end of the musical strings. Preferably the recess has a form to match and receive a spherical, cylindrical, or rectangular shape anchor lump.

Preferably the stop bar is arranged to attach to a sound board of a stringed musical instrument and to guide strings of the instrument to a saddle attached to the sound board.

Advantageously the stop bar is simple and portable. Preferably the stop bar is monolithic. It is separate from the musical instrument, and from the sound board, and from the saddle. Preferably the stop bar does not touch the saddle when attached to the sound board.

Advantageously the stop bar is attachable and detachable from the sound board separate from the saddle.

Preferably said strings are anchored to the stop bar at the anchor holders. Preferably each string is anchored individually to an individual one of the anchors.

In use the stop bar is attached to the sound board at the first position distal from the saddle. When the stop bar is attached at this first position, the strings pass straight through the straight guides in the stop bar. The strings define straight lines with respect to the profile of the sound board from the first location to the saddle which separates the strings from the sound board.

Preferably the stop bar comprises an attachment device to attach the stop bar at the first position on the sound board an adjustable distance from the saddle. The distance of the guides with respect to the saddle is thereby adjusted. By adjustment the stop bar is placed at the first position on the sound board where each of the straight guides aligns with a straight line from the saddle to the anchor holder or each anchor holder for each of the strings.

Preferably the attachment device is arranged to cooperate with a connector which the sound board comprises to attach the stop bar at the first position. Preferably the attachment device is arranged with cooperate where the connector is at the first position.

Advantageously the attachment device facilitates attaching the stop bar to sound board so as to align the straight guides with straight lines from the saddle the anchor holders.

Preferably the stop bar is monolithic so that in one step of attaching the stop bar to the sound board at the first position, the straight guides and anchor holders are aligned with the straight lines from the saddle to the anchor holders.

Preferably the attachment device is a slot through the stop bar to receive an attachment post on the sound board or vice versa. Preferably the slot passes through the flat side. Preferably the slot extends perpendicular to the flat side through the stop bar.

The stop bar is attachable to the sound board by placing the flat side on the sound board where the post protrudes through the slot and then tightening a nut on the post against the stop bar.

Preferably the slot cross section is longer than it is wide. Preferably the slot has an opening in the neck side of the stop bar.

Preferably the slot is aligned with the length wise dimension of the cross section substantially parallel to the guide. Advantageously the stop bar may slide on the sound board past the post extending from the sound board to the first position distal from the saddle to guide the musical strings from the anchor holders to the saddle in straight lines in view of the sound board profile.

Preferably the attachment device is arranged to cooperate with the connector which the sound board comprises so as to orient the direction of the straight guides. Preferably the attachment device comprises a tongue in groove arrangement with the connector or a separated pair of the slots or posts for this purpose.

The saddle separates the strings from the sound board. The saddle supports the strings. Typically, the saddle is located intermediate the stop bar and the neck. String tensioners on the neck pull the strings from the anchor holders over the saddle.

Where the stop bar is attached in use to the sound board is at the distance from the saddle which aligns each straight guide with each of the straight lines form the anchor holder to the saddle. A musician or manufacturer of the musical instrument can attach the stop bar to the sound board at this first position, preferably by placing the post through the slot.

The string is supported solely by the anchor holder and the saddle. Between the anchor and the saddle, the string passes straight through the guide without being bent. So, the string is not likely to break between the anchor point and the saddle. There is no breakpoint at the exit of the straight guides on the neck side of the stop bar.

Advantageously each guide is easily formed by simply drilling a guide hole straight through the stop bar. Each guide is arranged to align with a straight line from the anchor holder to the saddle by attachment of the stop bar to the sound board. Advantageously a stringed musical instrument is easily retrofitted or manufactured with the stop bar. By simply attaching the stop board to the sound board the manufacturer or musician may align the guides so that when the string is anchored to the stop bar and pulled over the saddle so that the saddle supports the string, the string will define a straight line from the anchor holder to the saddle which separates the strings from the sound board.

Preferably the stop bar is arranged so that attachment of the flat side of the stop bar to the sound board aligns each guide at an angle relative to the sound board of between 1 degree and 89 degrees. Preferably each guide is set in the stop bar permanently such as by drilling the guide as a guide hole through the stop bar.

Because the straight guides are non-parallel to the flat side, attaching the flat side of the stop bar to the sound board sets each guide at an angle relative to the sound board. In use for playing music on the instrument the string is strung from the first location to the saddle so stringing the musical instrument sets the string along the straight line.

Advantageously the stop bar is arranged so that attachment of the stop bar to the sound board aligns each guide at an angle relative to the sound board which is co-linear with the straight line from the anchor holder to the saddle. Preferably the angle is between 1 degree and 89 degrees because the string is strung between the anchor holder and the saddle at the same angle relative to the sound board of between 1 degree and 89 degrees.

The angle which provides for a straight line from the anchor holder to the saddle is determined in part by the distance between the point on the saddle which supports the string and the anchor holder when the stop bar is attached at the first position distal from the saddle. The angle is also determined in part by the direction from the anchor holder to the point on the saddle.

Preferably the guides are at an angle relative to the flat side of the stop bar of between 5 and 35 degrees, and more preferably between 10 and 20 degrees, and more preferably of 16 degrees.

Preferably attachment of the flat side of the stop bar to the sound board aligns each guide at an angle relative to the sound board of between 5 degrees and 35 degrees.

Advantageously many stringed musical instruments are strung so that the angle relative to the sound board of the string between the first location and the saddle is between 5 degrees and 35 degrees.

Preferably attachment of the flat side of the stop bar to the sound board aligns each guide at an angle relative to the sound board of between 10 degrees and 20 degrees.

Advantageously guitars are typically strung so that the angle relative to the sound board of the string between the first location and the saddle is between 10 degrees and 20 degrees.

Preferably attachment of the flat side of the stop bar to the sound board aligns each guide at an angle relative to the sound board is 16 degrees. Advantageously guitars experimentation has shown that this angle is advantageous because the string is pulled firmly against the saddle for good musical tone by being strung straight from the first location on the stop bar to the saddle.

Preferably all guides are set the same angle in the stop bar relative to the flat side. Preferably all the guides mutually parallel. So, when the stop bar is attached to the sound board all the guides are set at the same angle relative to the sound board.

For example, a stop bar suitable for six string guitar preferably has six guides, one guide for each string. The six strings are aligned in parallel; this includes the portions of the strings between the saddle and the first location where the strings are also in parallel. The guides are all set the same angle, so all the strings are guided in parallel straight lines by guides.

Preferably the stop bar has the form of an elongate bar. Preferably the flat side comprises portions at longitudinally distal ends of the elongate bar. Preferably the flat side is a side of the bar. Preferably the straight guides are transverse to the longitudinal direction of the elongate bar.

Preferably the straight guides are evenly spaced along the longitudinal direction of the elongate bar.

Preferably the straight guides are intermediate portions of an attachment device for the connector to attach the stop bar to the sound board. Preferably the straight guides are intermediate a pair of slots through the flat side for receiving posts to attach the stop bar to the sound board. The slots comprise an attachment device for attaching the stop bar the sound board. The slots cooperate with the posts which are a connector that the sound board comprises to attach the stop bar to the sound board. Preferably the straight guides are symmetrically arranged intermediate the slots. Advantageously the stop bar is useable on either a right handed or left handed guitar.

According to another aspect of the invention there is a stringed musical instrument comprising a stop bar as described herein. Preferably the stringed musical instrument has musical strings and a sound board on which there is a saddle to support the strings, comprising: a stop bar attached to the sound board distal from the saddle, the stop bar comprising: anchor holders, and straight guides non parallel to a flat side of the stop bar which guide the musical strings from the anchor holders to the saddle in straight lines non parallel to the sound board in view of the sound board profile.

Preferably the stringed musical instrument is a banjo or a guitar.

When the stop bar is in use the strings pass straight from the anchor holder to the saddle. There is no bend in the strings from the anchor of the string to the point on the string which contacts the saddle. There is no bend in the strings between these locations whether the strings are in view of the profile of the sound board or viewed from any other view.

Advantageously the strings of the instrument are less prone to breakage. The strings are suspended straight from the anchor holders to the saddle. Hence the strings are unlikely to break where the strings exit the stop bar since the stop bar does not bend the strings.

The exit of the straight guide in the neck side is preferably further from the flat side than the exit of the straight guide in the anchor side to accommodate the straight guides being non-parallel to the flat side. The strings turn over the saddle toward the stop bar and the sound board. The sharpness of turning toward the sound board is reduced by exit of the straight guide being further from the flat side and therefore further from the sound board. Advantageously the strings are less prone to breakage over the saddle because the turn angle is reduced and less sharp.

According to another aspect of the invention there is a method of attaching musical strings to a stringed musical instrument having a sound board on which there is a saddle to support musical strings and a stop bar as described herein attached to the sound board distal from saddle. Preferably the stop bar comprises anchor holders and straight guides non parallel to the sound board, and the method includes: threading each of the musical strings through each one of the straight guides respectively, drawing each of the strings over the saddle, and tensioning the strings to straight lines through the straight guides non parallel with respect to the profile of the sound board from the anchor holder to the saddle.

Preferably the method includes setting the flat side of the stop bar against the sound board. Preferably the method includes locating the stop bar at the first position distal from the saddle to guide the musical strings from the anchor holders to the saddle in straight lines.

The invention will now be described, by way of example only, with reference to the accompanying drawings in which:

DETAILED DESCRIPTION OF THE INVENTION

Figure 1:
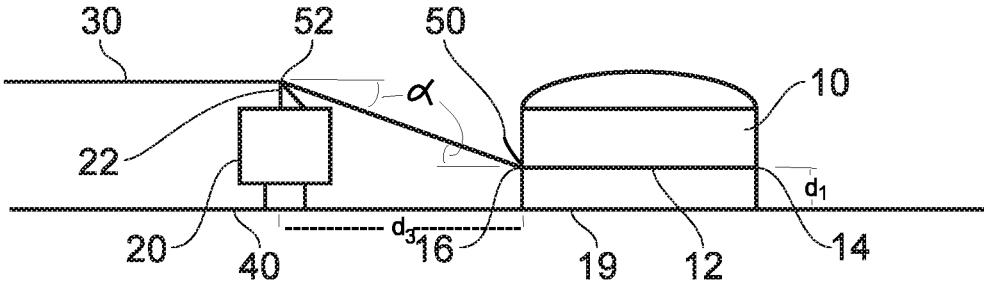
FIG. 1 (PRIOR ART)
FIG. 1 shows a schematic of a conventional stop bar attached to a sound board which anchors a string of a musical instrument supported by a saddle.

Referring to the Figures, there is shown in FIG. 1 a conventional stop bar 10 attached to a sound board 40 of a body of a stringed instrument. The conventional stop bar 10 anchors a string 30 of the musical instrument to the sound board 40. The string 30 is supported away from the sound board 40 by a saddle 22.

The saddle 22 attached to the sound board 40 by a bridge 20. The saddle 22 is located between the conventional stop bar 10 and a neck of the musical instrument which extends from the body. The neck is not shown in FIG. 1.

As can be seen in FIG. 1, the conventional stop bar 10 bends the string 30 where it grasps them. There is a break point 50 on the string 30 where at the exit location 16 on the conventional stop bar 10. The exit location 16 is where the string 30 is bent toward the saddle 22. The there is another break point 52 of the string at the location where string is supported the saddle 22 on the string.

FIG. 1 shows the string 30 guided through the conventional stop bar 10 by a guide 12 formed in the conventional stop bar 10. The guide 12 is aligned substantially parallel to the sound board 40. The string 30 follows a line from the exit of the guide 16 to the saddle 22 that is not parallel to the sound board 40.

The conventional stop bar 10 is arranged with a flat side 19 for attaching it to the sound board 40. So, by attaching the flat side 19 to the sound board 40, the guide 12 is aligned substantially parallel to the sound board.

Figure 3:
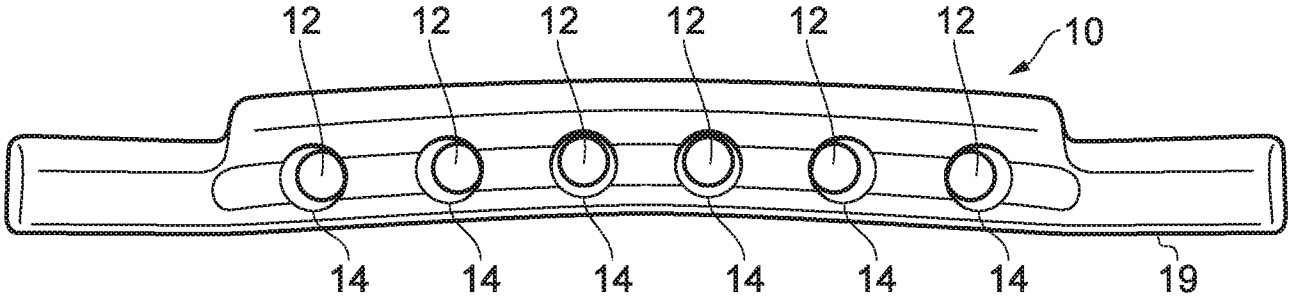
FIG. 3 (PRIOR ART)
FIG. 3 shows a view of the anchor side of a conventional stop bar.
Figure 4:
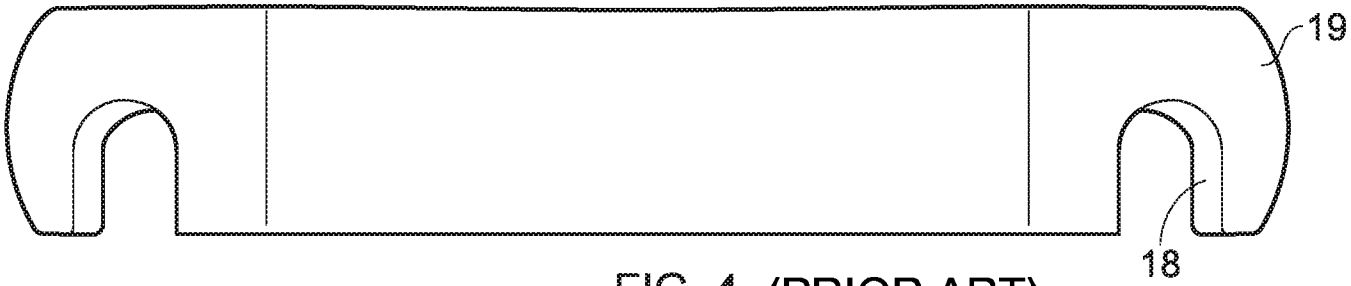
FIG. 4 (PRIOR ART)
FIG. 4 shows a view of the sound board side of a conventional stop bar.
Figure 5:
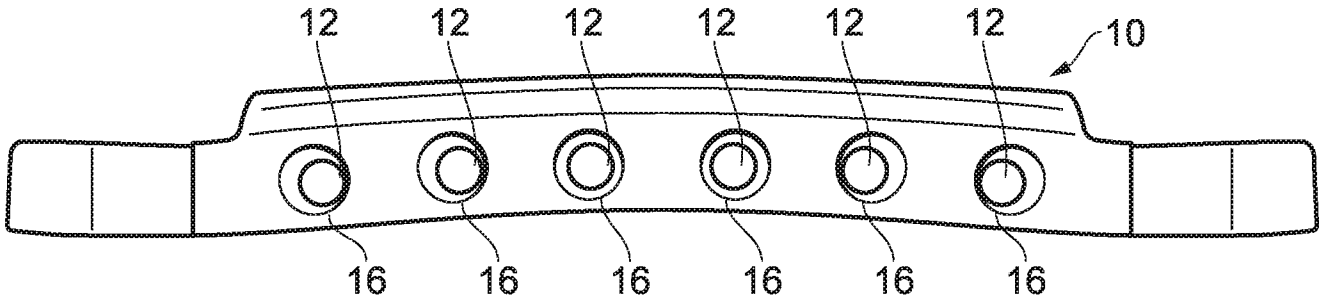
FIG. 5 (PRIOR ART)
FIG. 5 shows a view of the neck side of a conventional stop bar.

FIGS. 3, 4, and 5 show the anchor side of the conventional stop bar 10, the sound board side of the conventional stop bar 10, and the neck side of the conventional stop bar 10 respectively.

The anchor side of the conventional stop bar 10 is so called because the string 30 has attached to one and an anchor lump which is typically a ball. The string 30 pulls the anchor ball against the anchor side of the conventional stop bar 10 where the guide 12 exits the conventional stop bar 10. This is where the anchor ball is pulled into an anchor holder 14.

The anchor holder 14 is a recess which has a cross section greater than the minimum cross section of the straight guide.

In FIG. 3 the exit 14 of the guide 12 can be seen on the anchor side of conventional stop bar 10. In FIG. 5 the exit 16 of the guide 12 can be seen on the neck side of the conventional stop bar 10. The exit 14 on the anchor side is at the same distance from the flat side 19 of the conventional stop bar 10 as the exit 16 on the neck side. This is because the guide 12 through the conventional stop bar 10 is substantially parallel to the sound board 40 when the conventional stop bar 10 is attached to the sound board.

Figure 2:
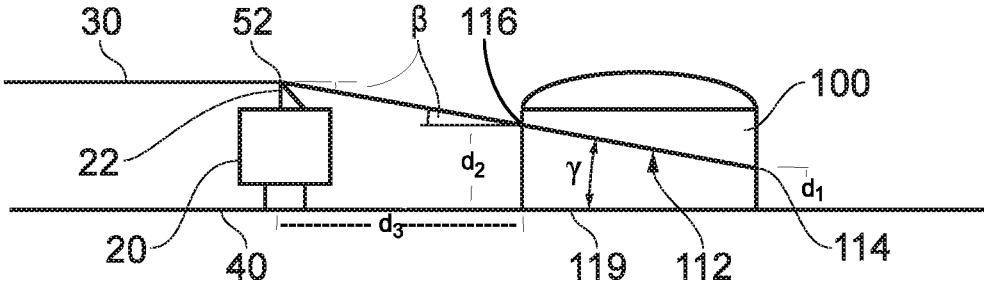
FIG. 2 shows a schematic of a new stop bar attached to a sound board which anchors a string of a musical instrument supported by a saddle.

FIG. 2 shows a new stop bar 100. The new stop bar 100 is attached to a sound board 40.

The distance which can be seen in FIG. 1 from the neck side where the neck side exit 16 is located to the anchor side where the anchor holder 14 is located is the width of the conventional stop bar 10. The distance which can be seen in FIG. 2 from the neck side where the neck side exit 116 is located to the anchor side where the anchor holder 114 is located is the width of the new stop bar 100. The width of the conventional stop bar 10 and the new stop bar 100 is the same.

It is not generally necessary for the width of new stop bar 100 to be the same as the width of the conventional stop bar 10. The new stop bar 100 replaces the conventional stop bar 10. So, the new stop bar 100 is independent of the conventional stop bar 10.

The new stop bar 100 has a flat side including a flat surface 119 on the side of the new stop bar 100 that is attached to the sound board 40. The flat surface 119 facilitates attachment of the new stop bar 100 to the sound board 40. The flat side comprises another portion 120 at the longitudinally distal end of the elongate bar.

The new stop bar 100 is attachable to a stringed musical instrument sound board 40 which is shown in profile in FIG. 2. There is a saddle 22 to support musical strings. One of the strings 30 is visible in the profile view of FIG. 2.

The new stop bar 100 comprises anchor holders at exits 114 to the straight guides 112. The straight guides are non-parallel to a flat side 119 of the new stop bar 100. The flat side 119 is attached to the sound board 40 at a first position distal from the saddle 22 to guide the musical strings 30 from the anchor holder 114 to the saddle in straight lines in view of the sound board 40 profile.

As shown in FIG. 2, the new stop bar 100 is attachable to the sound board at a first position distal from the saddle 22 to guide the musical strings 30 from the anchor holders 114 to the saddle 22 in straight lines in view of the sound board profile 40.

The first position is determined by the distance $d_3$ from the new stop bar 100 to the saddle 22 as shown in FIG. 2.

As shown in FIG. 1 the conventional stop bar 10 is attached to the sound board in the first position. The conventional stop bar 10 is attached to the sound board the same distance $d_3$ from the saddle.

The new stop bar 100 easily replaces the conventional stop bar 10. The conventional stop bar 10 is simply unattached from the sound board 40. The new stop bar 100 is attached to the sound board in place of the conventional stop bar 10.

The new stop bar 100 comprises an attachment device 118. The attachment device 118 is arranged to attach the new stop bar 100 to the sound board at the first position. The attachment device includes a slot 118 through the bar 100.

The new stop bar 100 is an elongate object. When attached to the sound board 40 the new stop bar 100 has a neck side which is nearest the neck of instrument and the saddle and an anchor side opposing the neck side. The string 30 is anchored against the anchor side in anchor holder 114.

These neck side and anchor side are parallel and are the long sides of the elongate object.

The straight guides 112 are transverse to the longitudinal direction of the elongate new stop bar 100.

The new stop bar 100 has a guide 112 through it. The guide 112 penetrates through the new stop bar 100 from the neck side to the anchor side. The anchor side is perpendicular to the flat side 119.

In the new stop bar 100 guide 112 is set an angle with respect to the flat side 119. When the flat side 119 is set against the sound board 40, the guide 112 is set at an angle with respect to the sound board.

The angle of the guide 112 with respect to the flat side 119 is preselected so that when the new stop bar 100 is attached to the sound board 40 the guide 112 is aligned with the string 30. The guide 112 penetrates straight through the new stop bar 100. The string 30 follows a straight line from the location of the exit 114 of the guide 112 located on the anchor side of the new stop bar 100 to the location of the exit 116 of the guide 112 located on neck side of the new stop bar 100. As shown in FIG. 2 the string 30 continues in the same straight line from the exit 116 of the guide to the saddle.

An advantage of the new stop bar 100 is the angle 'gamma' of the guide 112 with respect to the flat side 119 is such that the string 30 follows a straight line from the anchor holder 114 at the exit of the straight guide 112 distal from the saddle where the string 30 is anchored to the stop bar to the break point 52 where the string 30 is supported by the saddle 22. With the new stop bar 100 there is no breaking point on the string at the exit 116 of guide 112 because the string does not bend at the exit 116. This can be seen in FIG. 2.

In contrast, the conventional stop bar 10 has a breaking point 50 which can be seen in FIG. 1. The string is forced to bend by the edge of the conventional stop bar 10 at the break point at the exit 16 of the guide 12 on the neck side of the conventional stop bar 10.

The angle of the string 30 with respect to the sound board is shown as 'beta' in FIG. 2. The angle of the guide 112 with respect to the flat side 119 is shown as 'gamma' in FIG. 2. The angle 'beta' is the same as the angle 'gamma'. So, the string 30 continues in a straight line from the anchor holder 114 through the straight guide 112 to the saddle 22.

The angle of the guide 112 'gamma' with respect to the flat side 112 that makes the guide 112 align with the straight path of the string depends on the relative distance and angle of the saddle with respect to the new stop bar 100.

The angle of the guide 'gamma' may be any angle from 1 to 89 degrees so that the string 30 follows a straight line from the anchor holder 114 of the guide 112 where it is anchored to the saddle 22 depending on the relative distance and angle of the saddle with respect to the new stop bar 100.

The angle 'gamma' to make the string follow the straight line will be between 5 and 35 degrees for some stringed musical instruments. The angle 'gamma' to make the string follow a straight line for some stringed musical instruments will be between 10 and 20 degrees. An angle 'gamma' which is particularly advantageous is 16 degrees because the string 30 bends 16 degrees at the saddle 22. The string 30 is pulled tight against saddle for good musical tone.

Figure 6:
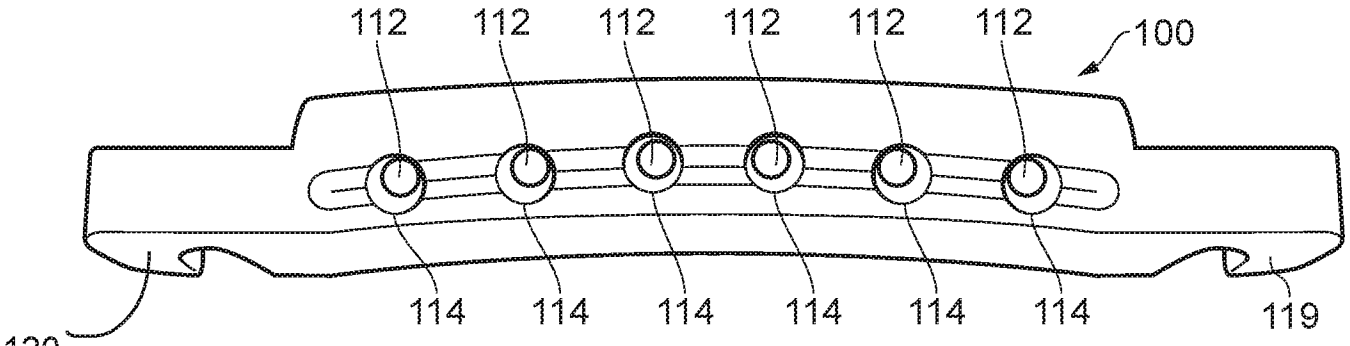
FIG. 6 shows a view of the anchor side of the new stop bar.
Figure 7:
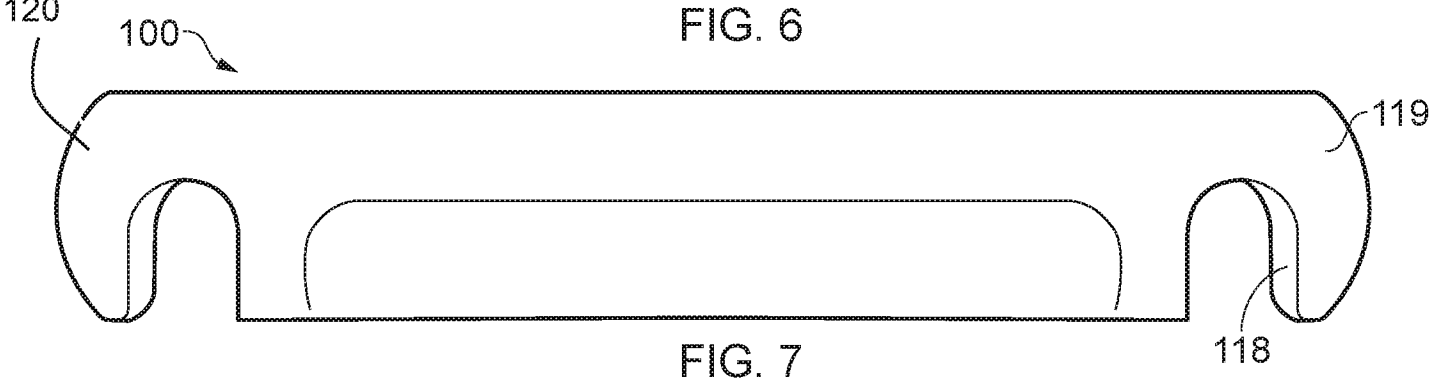
FIG. 7 shows a view of the sound board side of the new stop bar.
Figure 8:
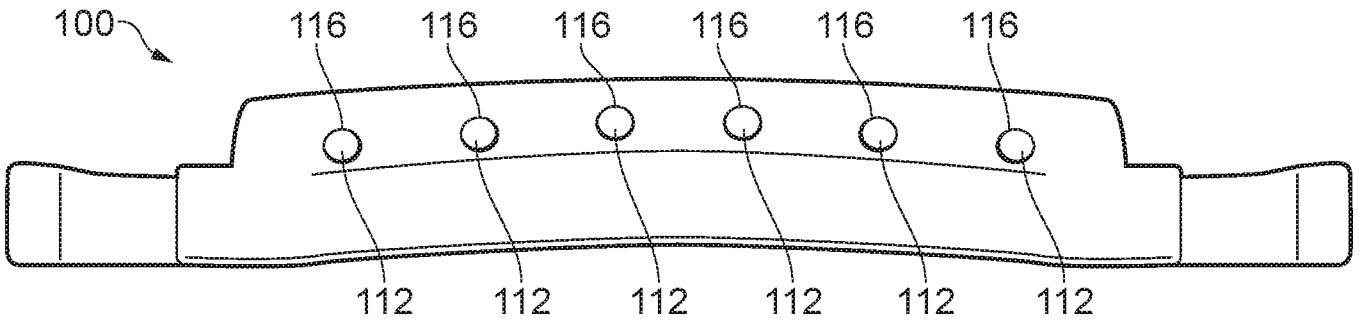
FIG. 8 shows a view of the neck side of the new stop bar.

The new stop bar 100 shown in FIGS. 6, 7, and 8 has an angle 'gamma' of about 16 degrees with respect to the flat side 119. The height above the flat side 119 of the exit 114 on the anchor side of the new stop bar 100 as shown in FIG. 2 is lower than the height of the exit 116 on the neck side of the stop bar 100. This is due to the angle 'gamma' of the guide 112 which is a guide hole straight through the stop bar 100. The guide hole passes through the new stop bar 100 along a straight path. The axis of the straight path and the axis of the strings are substantially coincident as the string follows a straight line through the guide hole.

The diameter of the guide hole is greater than diameter of the string 30. While the strings are being played the relative diameter of the guide hole to the diameter of the string through the guide hole is such the string does not touch the side of guide hole while the string is vibrating. The string is attached to the musical instrument by threading the strings through the guide holes.

FIG. 2 and FIGS. 6, 7, and 8 show the new stop bar 100 arranged to attach to a sound board 40 of a stringed musical instrument and to guide musical strings 30 anchored to the new stop bar 100 in a straight line from an anchor 114 to a saddle 22 which separates the strings 30 from the sound board 40, comprising: a row of guides 112 aligned with each string 30 by an angle 'gamma' set by attachment of the new stop bar 100 to the sound board 40.

FIG. 2 and FIGS. 6, 7, and 8 also show the new stop bar 100 arranged to attach to a sound board 40 of a stringed musical instrument to guide strings 30 of the instrument anchored to the new stop bar 100 in a straight line from an anchor 114 to a saddle 22 which separates the strings 30 from the sound board 40, comprising: a row of guides 112 aligned with each string 30 by an angle 'beta' set by attachment of the new stop bar 100 to the sound board 40.

FIG. 2 and FIGS. 6, 7, and 8 also show the new stop bar 100 arranged to anchor musical strings 30 to the sound board 40 of a stringed musical instrument comprising the saddle 22 fixed to the sound board, comprising: a row of guides 112 in register with anchors 114 to guide the strings 30 from the anchors 11 at angles 'beta' with respect the sound board 40 which are straight from anchor to support on the saddle. The angle 'gamma' between the guides 112 and the flat surface 119 on the new stop bar 100 is the same as the angle 'beta'.

Each straight tube which forms a guide 112 is arranged to guide a string 30 in a straight line from the point 114 where the string is anchored to the new stop bar 100 to the crest of a saddle 22 fixed to the sound board 40.

The row of guides 112 is arranged to guide the strings 30 in parallel lines at an angle 'gamma' with respect to the sound board 40 which is the same as the angle 'beta' of the guide 112 with respect to the flat surface 119.

The angle of the string 30 with respect to the sound board 40 is shown as 'alpha' for the conventional stop bar 10 in FIG. 1. The angle 'alpha' is indicative of the sharpness of the bend in the string 30 over the saddle 22.

Similarly, the angle of the string 30 with respect to the sound board 40 is shown as 'beta' for the new stop bar 100 in FIG. 2.

The shortest distance from the flat side 119 to the anchor holder 114 is shown as distance $d_1$ in FIG. 2. The shortest distance from the flat side 119 to the exit 116 of the straight guide 112 in the neck and saddle side of the new stop bar 100 is shown as distance $d_2$.

Since the straight guides 112 are non parallel to the flat side 119, the distance $d_2$ is greater than the distance $d_1$.

The exit 116 of the straight guide 112 in the neck side is at a distance $d_2$ further from the flat side 199. The exit of the straight guide into the anchor holder 114 is at a distance $d_1$ from the flat side 119. The straight guide 112 is non parallel to the flat side 119.

The distance $d_2$ of the exit in the neck side is further from the flat side than the distance $d_1$ of the exit into the anchor holder 114.

The sharpness of the bend over the saddle 22 in the string 30 when conventional stop bar 10 is attached at the first position is indicated by the angle 'alpha'. The sharpness of the bend over the saddle n the string 30 when the new stop bar 100 is attached at the first position is indicated by the angle 'beta'.

Comparing FIGS. 1 and 2 shows that sharpness of the bend in the string 30 indicated by 'alpha' is greater than the sharpness indicated by 'beta'.

In use of the new stop bar 100, the sharpness of the string turning over the saddle toward the sound board is reduced because the exit in the neck side of the straight guide is further from the flat side than the exit in the anchor side. In other words, because $d_2$ is greater that $d_1$, and the exit in the neck side is further from the sound board and closer to the level of the saddle 22 above the sound board. So, the string 30 anchored by the new stop bar 100 is less likely to break at the saddle 22 breakpoint 52 than the string anchored by the conventional stop bar 10.

The flat surface 119 is arranged to attach and adhere the new stop bar 100 to the sound board 40.

The new stop bar 100 has an attachment device in the form of a groove or slot 118 through it as shown in FIG. 7. The slot 118 is to receive an attachment post protruding from the sound board. The attachment post is not shown in the Figures. The slot 118 passes through the flat side 119. The slot 118 extends through the stop bar and perpendicular to the flat side 119.

The new stop bar 100 is attached to the sound board 40 by placing the flat side 119 on the sound board where the post protrudes through the slot and then tightening a nut on the post against the stop bar.

The slot 118 has an opening in the neck side. The neck side is opposite the anchor side which includes the anchor holder 114 recesses. The slot 119 extends substantially parallel to the straight guides 112 from the slot opening towards the anchor side.

Although not shown in the Figures, the slot could be in the sound board and the post on the stop bar, and other attachment devices are also suitable for attaching the stop bar to the sound board at the first position.

Thus, before being tightly bolted in the first position on the sound board, the new stop bar 100 may be set an adjustable distance from the saddle 22. The new stop bar 100 is thereby placed at the distance $d_3$ from the saddle to ensure the strings 30 pass in a straight line from the anchor holder 114 to the saddle 22.

The distance $d_3$ is shown in FIG. 2 is shown as the same as the distance $d_3$ in FIG. 1 because conventional stop bar 10 and new stop bar 100 have the same width and distance from the anchor holder 14, 114 to the flat side 19, 119. For a new stop bar 100 with a different width or distance from anchor holder to flat side, the distance from the saddle to the neck side of the stop bar could be different and still alight the straight guides 112 and anchor holders 114 in a straight line from the anchor holders 114 to the saddle 22.

The new stop bar 100 is arranged to be joined to the sound board so that the strings are perpendicular to the row of straight guides 112. To set the direction of the straight guides the attachment device comprises first slot 118 in a first portion 119 of the flat side separated from a second slot in a second portion of flat side 120.

A method of attaching the strings 30 to the musical instrument is possible with the new stop bar 100. The new stop bar 100 is in the form of an elongate bar for joining to a sound board of the instrument comprising a plurality of string anchors 114 corresponding to each musical string 30 of the instrument for anchoring each string in line with the crest of the saddle 22 fixed to the sound board 40.

The method of anchoring a musical string to a sound board of a musical instrument maybe adapted so the string is guided through an angle 'beta' to the sound board of between 1 and 89 degrees by threading the string through the guide 112 in the form of a straight tube in the new stop bar 100 fixed to the sound board 40. The string is pulled in a straight line from the anchor holder 114 location through the tube 112 to the saddle 22, which supports the string 30, fixed to the sound board 40 by the stop bar 100.

The invention has been described by way of examples only. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the claims.

The invention claimed is:

1. A stop bar attachable to a stringed musical instrument sound board on which there is a saddle to support musical strings, comprising:

an attachment device, anchor holders, and straight guides non parallel to a flat side of the stop bar attachable to the sound board at a first position, each of the straight guides configured to surround an entire circumference of a respective one of the musical strings across the stop bar, each of the straight guides including a respective one of the anchor holders, and each of the straight guides has a first exit into a respective one of the anchor holders having a central axis colinear with the longitudinal axis of the straight guide, wherein the attachment device is arranged to cooperate with a connector which the sound board comprises at the first position distal from the saddle to attach the stop bar at the first position and align the straight guides to guide the musical strings straight from the anchor holders to the saddle from all points of view.

2. The stop bar according to claim 1 wherein the straight guides pass though the stop bar.

3. The stop bar according to claim 2 wherein each of the straight guides is formed by a guide hole.

4. The stop bar according to claim 2 wherein the straight guides pass through opposite sides of the stop bar; the opposite sides each being substantially perpendicular to the flat side.

5. The stop bar according to claim 1 wherein each of the straight guides has a minimum cross section dimension in a range from 0.2 mm to 4 mm to provide clearance for each of the musical strings.

6. The stop bar according to claim 1 wherein the straight guides are at an angle relative to the flat side of between 5 degrees and 35 degrees.

7. The stop bar according to claim 1 wherein all the straight guides are set to the same angle with respect to the flat side.

8. The stop bar according to claim 1 wherein all the straight guides are mutually parallel.

9. The stop bar according to claim 1 wherein the straight guides each have a first exit from the stop bar in a recess in the respective one of the anchor holders and an opposite second exit further from the flat side than the first exit.

10. The stop bar according to claim 1 wherein the attachment device attaches the stop bar to the sound board an adjustable distance from the saddle.

11. The stop bar according to claim 10 wherein the straight guides are symmetrically arranged intermediate a pair of slots through the flat side for receiving posts to attach the stop bar to the sound board.

12. The stop bar according to claim 1 which is monolithic.

13. A stringed musical instrument having musical strings and a sound board on which there is a saddle to support the strings, further comprising a stop bar attached to the sound board distal from the saddle, the stop bar comprising:

an attachment device, anchor holders, and straight guides non parallel to a flat side of the stop bar which guide the musical strings from the anchor holders to the saddle in straight lines non parallel to the sound board in profile view of the sound board, each of the straight guides surrounding an entire circumference of a respective one of the musical strings across the stop bar, each of the straight guides including a respective one of the anchor holders, and each of the straight guides has a first exit into a respective one of the anchor holders having a central axis colinear with the longitudinal axis of the straight guide, wherein the attachment device cooperates with a connector which the sound board comprises at a first position to attach the stop bar at the first position.

14. The stringed musical instrument according to claim 13 which is a guitar or banjo.

15. A method of attaching musical strings to a stringed musical instrument having a sound board on which there is a saddle to support the musical strings and a stop bar attached to the sound board distal from the saddle, the stop bar comprising:

an attachment device, anchor holders and straight guides non parallel to a flat side of the stop bar attachable to the sound board at a first position distal from the saddle to guide the musical strings from the anchor holders to the saddle in straight lines in profile view of the sound board, each of the straight guides surrounding an entire circumference of a respective one of the musical strings across the stop bar, each of the straight guides including a respective one of the anchor holders, and each of the straight guides has a first exit into a respective one of the anchor holders having a central axis colinear with the longitudinal axis of the straight guide, wherein the attachment device cooperates with a connector which the sound board comprises at the first position to attach the stop bar at the first position, the method including:

threading each of the musical strings through each one of the straight guides respectively, drawing each of the musical strings over the saddle, and tensioning the musical strings to form straight lines through the straight guides non parallel with respect to the profile view of the sound board, from each respective one of the perpendicular anchor holders to the saddle.

16. The stop bar according to claim 1 wherein the straight guides are at an angle relative to the flat side of between 10 degrees and 20 degrees.

17. The stop bar according to claim 1 wherein the straight guides are at an angle relative to the flat side is 16 degrees.

* * * * *